United States Patent [19]

Boltrek

[11] Patent Number: 4,562,914

[45] Date of Patent: Jan. 7, 1986

[54] HANDRAIL APPARATUS

[75] Inventor: Henry Boltrek, Freeport, N.Y.

[73] Assignee: Westinghouse Electric Corp., Pittsburgh, Pa.

[21] Appl. No.: 547,296

[22] Filed: Oct. 28, 1983

[51] Int. Cl.[4] ..... B66B 23/22; B66B 23/24

[52] U.S. Cl. ..... 198/336

[58] Field of Search ..... 198/336, 335, 337, 338

[56] References Cited

U.S. PATENT DOCUMENTS

| | | | |
|---|---|---|---|
| 984,304 | 2/1911 | Seeberger | 198/336 |
| 3,651,919 | 3/1972 | Vollmer | 198/336 |
| 3,712,447 | 1/1973 | Boltrek et al. | 198/336 |
| 4,239,102 | 12/1980 | Boltrek | 198/336 |

*Primary Examiner*—Joseph E. Valenza
*Assistant Examiner*—Daniel R. Alexander
*Attorney, Agent, or Firm*—D. R. Lackey

[57] ABSTRACT

Continuously self-adjusting handrail apparatus for transportation apparatus, such as escalators and walks, in which the handrail guide automatically responds to forces therein to reduce the magnitude of load induced forces which tend to dislodge the handrail from its guide. The curved guide section adjacent each newel of an associated balustrade is arranged to change its curvature and increase or decrease its length, as required, in response to such forces, with the forces being such that when one section increases its length, the other section reduces it length.

1 Claim, 7 Drawing Figures

HANDRAIL APPARATUS

BACKGROUND OF THE INVENTION

1. Field of the Invention

The invention relates in general to handrail apparatus, and more specifically to handrail apparatus for a transportation system, such as an escalator, which includes a continuous, flexible handrail member which is both pushed and pulled about a substantially continuous guide loop.

2. Description of the Prior Art

U.S. Pat. No. 3,712,447, which is assigned to the same assignee as the present application, discloses a handrail guide system for passenger conveyors, such as escalators and movable walks, which permits the handrail to be both pushed and pulled about a substantially continuous guide loop. This arrangement has many advantages over apparatus which obtains the tractive force necessary to propel the handrail member by only pulling it around a discontinuous guide loop. The latter arrangement develops a relatively large tension in the handrail member, causing it to wear and stretch. In the hereinbefore mentioned U.S. patent, the length of the guide loop is initially adjusted to the length of the handrail loop.

U.S. Pat. No. 4,239,102 improves upon the handrail guide system of U.S. Pat. No. 3,712,447 by disclosing a guide loop is a push-pull system which automatically adjusts its length in response to changes in the loop length of the handrail member. In this patent, a flexible portion of the guide loop is cut, and the cut ends are linked by a biasing arrangement which biases the cut ends away from one another. The guide loop length is initially adjusted via a manually adjustable take-up, such that a predetermined gap is produced between the cut ends of the flexible portion of the guide loop, enabling the loop length of the handrail to increase, or decrease, over a predetermined adjustment range. The biasing means is selected to create a very slight tension in the handrail over the entire adjustment range.

The push-pull handrail system has certain disadvantages when subjected to a load by passengers on the transportation apparatus. The load induced forces cause the handrail to press against the handrail guide, especially adjacent the curved ends of the guide loop, causing undue wear of the handrail and guide member. The problem becomes even more acute when the push-pull handrail system is applied to rises higher than about 20 feet. The modular type of escalator drive disclosed in U.S. Pat. Nos. 3,677,388 and 3,707,220, makes almost any rise practical, as only one type of standard drive is used regardless of rise. Additional drives are simply added to the inclined portion of the truss to accommodate any particular rise. Each such drive includes a handrail drive. A single drive is used for rises up to about 20 feet. With a single drive, excess passenger load on the handrail will usually cause slippage at the handrail drive interface. While such slippage mars the appearance of the handrail, and reduces its useful life due to accelerated wear, the slippage limits the handrail-guide forces to the point where the handrail will usually stay on the guide. When more than one drive is used, however, the driving forces are so great it is difficult to cause the handrail to slip in the drives. Thus, load induced forces become so great that the handrail may pop off the guide. A prior art approach to preventing the handrail from being forced from its guide uses a plurality of rollers which are spaced between the uppermost drive of the modular drive arrangement and the uppermost newel of the balustrade. Each roller is positioned immediately below the handrail in this area, to limit the movement of the handrail in the downward direction, i.e., the direction which can cause the handrail to pop off the guide.

SUMMARY OF THE INVENTION

Briefly, the present invention is a new and improved handrail arrangement of the push-pull type suitable for transportation apparatus such as escalators and walks, including a substantially continuous guide arrangement having an upper guide portion, a lower guide portion, and first and second end guide portions which join the upper and lower guide portions. The new and improved handrail guide arrangement automatically and continuously accommodates drive forces and passenger load induced forces in the associated handrail without slippage at the drive-handrail interface, and without undue wear between the handrail and its guide. Further, the new and improved handrail guide arrangement prevents separation of the handrail from its guide without resorting to additional rollers or other brute force limiting means.

More specifically, the handrail guide arrangement includes first and second flexible, curved guide sections in the lower guide portion adjacent to the first and second end guide portions, respectively. Each such guide section is constructed such that its length is automatically and continuous changeable in the direction required to reduce the forces between the handrail and its guide. If the handrail tends to straighten the curved guide section, the curved guide section automatically accommodates these forces by increasing the radius of curvature of the section, while simultaneously reducing the length of the section. If the handrail tends to bunch-up, the radius of curvature of the curved flexible guide section automatically reduces while simultaneously increasing the length of the section.

In a preferred embodiment of the invention, each flexible curved guide section includes a plus-and-minus spring which is selected such that the spring is in its neutral position when the handrail is driven with no passenger load. When passenger load is applied, the spring of one curved guide section is compressed while the spring of the other curved guide section is expanded, to maintain the guide loop length the same as the handrail loop length, while selectively increasing and reducing the length of predetermined guide sections in response to the instantaneous forces in the handrail at any instant.

BRIEF DESCRIPTION OF THE DRAWINGS

The invention may be better understood, and further advantages and uses thereof more readily apparent, when considered in view of the following detailed description of exemplary embodiments, taken with the accompanying drawings in which.

DESCRIPTION OF THE PREFERRED EMBODIMENTS

Figure 1:
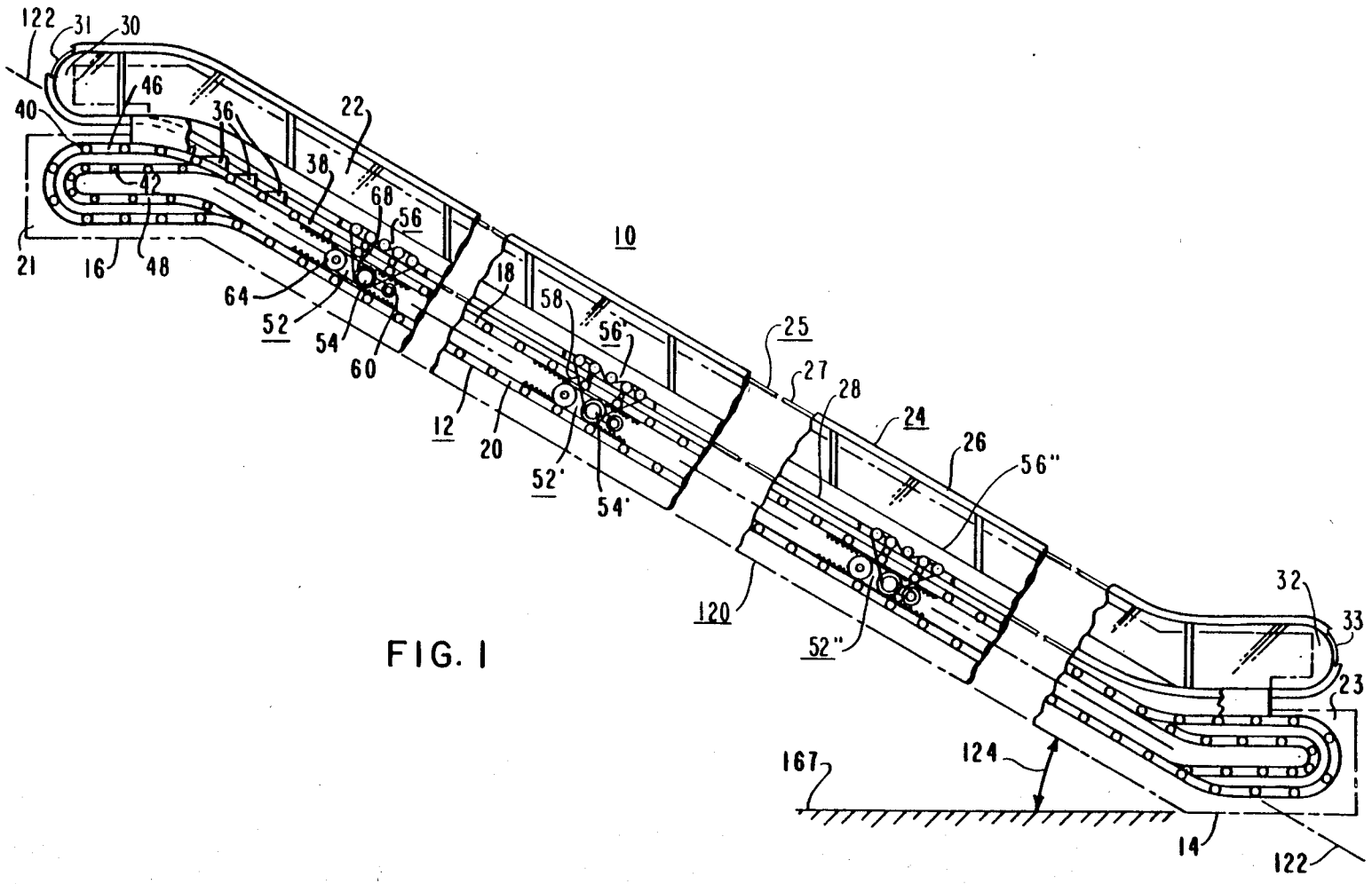
FIG. 1 is an elevational view of transportation apparatus having a handrail guide arrangement which may be constructed according to the teachings of the invention.

The present invention is an improvement relative to the push-pull handrail drive arrangement described and claimed in the hereinbefore mentioned U.S. Pat. No. 3,712,447. The push-pull handrail drive arrangement is illustrated in FIG. 1 as being used with the modular type of escalator and drive arrangement disclosed and claimed in the hereinbefore mentioned U.S. Pat. Nos. 3,677,388 and 3,707,220. Accordingly, these patents are hereby incorporated into the specification of the present application by reference. The invention, while particularly advantageous when used with the modular type of escalator drive, because of its ease in being applied to higher than normal rises, is not to be limited to any type of drive. The escalator driving arrangement of U.S. Pat. No. 3,712,447, for example, is equally suitable. Further, the invention is broadly suitable for use on transportation apparatus in general, of any type having a handrail driven in synchronism with a conveyor portion, such as electrically driven walks. Referring now to the drawings, and to FIG. 1 in particular, there is shown an escalator 10 which may utilize the teachings of the invention. While a plural drive escalator is illustrated, the invention is applicable to an escalator having one or more drives. Escalator 10 includes a conveyor or belt portion 12 for transporting passengers between a first landing 14 and a second landing 16. Conveyor 12 is of the endless articulated type, which is driven about a closed path or loop. Conveyor 12 includes an upper load bearing run 18 upon which passengers are supported while being transported between the landings 14 and 16, a lower return run 20, and upper and lower turnarounds 21 and 23, respectively, which interconnect the load bearing and return runs.

Conveyor 12 includes a plurality of steps 36. Steps 36 move in a closed path, driven by one or more modular drive units. First, second and third modular drive units 52, 52' and 52'', respectively, are shown in FIG. 1 for purposes of example. The drive units are supported by an inclined portion of a truss 120, with the uppermost drive unit 52 being mounted just below the transition between the horizontal landing portion and the inclined portion. The longitudinal axis 122 of the inclined portion of truss 120 makes an angle 124, such as 30°, with a horizontal plane 167. The endless, flexible conveyor 12 has first and second lateral sides, each of which are formed of rigid, pivotally interconnected toothed step links 38. The two sides of the conveyor 12 are interconnected by step axles 39 which extend through link bushings (not shown). The steps 36 are connected to the step axles, such as by the arrangement set forth in U.S. Pat. No. 3,789,972, which is assigned to the same assignee as the present application. Conveyor 12 is supported by guide and support rollers or wheels 40, which cooperate with guide tracks 46. The steps 36, in addition to being supported by conveyor 12, are also supported and guided by trailer wheels or rollers 42 which cooperate with trailer guide tracks 48 to guide and support the steps in the endless loop, and to cause articulation of the steps between platform and step modes at predetermined locations.

A continuous, flexible handrail 24 is disposed on each side of conveyor 12. Each handrail 24, which is substantially C-shaped in cross-section, is in the form of a continuous, closed loop, and it is mounted with the opening of the "C" disposed towards the center of the loop, whereby the base of the handrail is available to be grasped by passengers on the load run of the transportation apparatus.

Each handrail 24 is guided in its closed loop by a substantially continuous guide arrangement 25. The guide arrangement 25 has an upper guide portion 27 which extends along the upper surface of a balustrade 22, a lower guide section 29, and first and second end guide sections or portions 31 and 33 which are respectively supported by upper and lower newels 30 and 32 of the balustrade 22.

Handrail 24 includes upper and lower runs 26 and 28, respectively, which are joined at the loop ends defined by the end guide sections 31 and 33. The modular drive units, such as drive unit 52, each include a handrail drive pulley 54 mounted on a shaft 88 which drives a handrail drive unit 56 via a chain or belt 58. Handrail drive unit 56 may be of any suitable type capable of applying both a pushing and pulling force to the handrail, and which does not require that the handrail be under a high tension. The handrail drives disclosed in U.S. Pat. Nos. 3,414,109 and 3,779,360 are suitable for this purpose.

Figures 2, 3, 4:
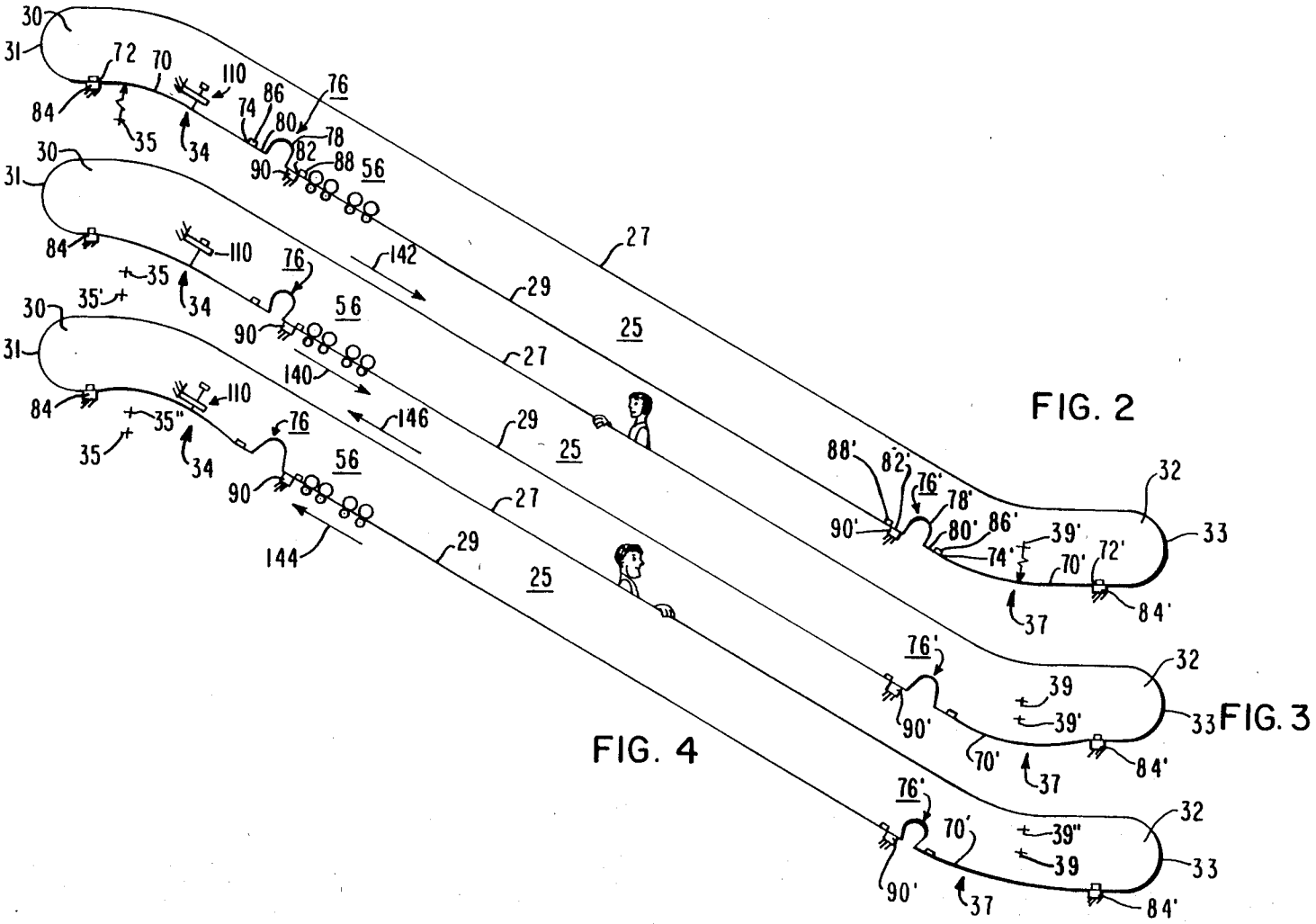
FIG. 2 is a diagrammatic view of the handrail guide arrangement shown in FIG. 1, modified according to the teachings of the invention, with the guide arrangement being shown in the configuration it assumes when the handrail is being driven in either direction, with no passenger load.
FIG. 3 is a view similar to that of FIG. 2, except illustrating the configuration of the handrail guide arrangement when the handrail is loaded by passengers who are being transported upwardly from a lower terminal to an upper terminal.
FIG. 4 is a view similar to that of FIGS. 2 and 3, except illustrating the configuration of the handrail guide arrangement when the handrail is loaded by passengers who are being transported downwardly from an upper terminal to a lower terminal.

The present invention recognizes that when passengers grasp the handrail 24, the resulting load induced forces, coupled with the forces applied to the handrail 24 by each handrail drive unit, tend to bunch up the handrail in the curved transition of the return run adjacent to one newel of the balustrade 22, and tend to straighten the handrail 24 in the curved transition adjacent to the other newel. If the escalator is transporting passengers in the down travel direction, the bunching occurs near the upper newel, and the straightening occurs near the lower newel. If the escalator is transporting passengers in the up travel direction, the bunching occurs near the lower newel nd the straightening occurs near the upper newel. This may be more easily understood with reference to FIGS. 2, 3 and 4, which diagrammatically illustrate the guide arrangement 25 constructed according to the teachings of the invention. FIG. 2 illustrates the configuration of guide arrangement 25 when the handrail 24 is being driven by one or more handrail drives 56, in either direction, with no passenger load. FIG. 3 illustrates the configuration of guide arrangement 25 when the escalator is transporting passengers in the up travel direction. Thus, the handrail drive 56 is driving the handrail 24 in the downward direction along the lower guide portion 29 of the guide arrangement 25. FIG. 4 illustrates the configuration of guide arrangement 25 when the escalator 10 is transporting passengers in the down travel direction. In this instance, handrail drive 56 is driving the handrail 24 in the upward direction along the lower guide portion 29 of the guide arrangement 25.

Guide arrangement 25 has first and second curved transitions 34 and 37 in the lower guide portion 29. The first curved transition 34 is adjacent to the upper newel 30, and the center 35 of the radius of the curve is located below the lower guide portion 29. The second curved transition 37 is located adjacent to the lower newel 32, and the center 39 of the radius of the curve is located above the lower guide portion 29.

According to the teachings of the invention, each of the curved transitions 34 and 37 is constructed such that they change length in opposite directions, i.e., one curved transition may shorten its guide length, while the other curved transition lengthens its guide length, in response to load induced forces in the handrail 24. The space for implementing these functions is severely limited, and the implementation of the functions must be able to fit within the available space, while allowing the use of a transparent balustrade 22, when desired. Accordingly, in a preferred embodiment of the invention, the upper curved transition 34 is constructed of a flexible guide member 70 having first and second ends 72 and 74, respectively, and a leaf spring 76. The lower guide portion 29 is located below the lower edge of the balustrade 22, and thus there is space available above the lower guide portion 29 for accommodating the leaf spring 76. Leaf spring 76 has a substantially U-shaped portion 78 and first and second straight portions 80 and 82, respectively. The U-shaped portion 78 has first and second normally parallel leg portions 79 and 81, respectively, and a curved bight portion 83. Flexible guide member 70 is formed of flexible but stiff material having a relatively low coefficient of friction, such as high density polyethylene, or other suitable plastic. Additives, such as molybdenun disulfide, may be used to lower the coefficient of friction of the particular plastic used.

The first end 72 of flexible guide member 70 is aligned with an end of the upper end guide portion 31, and fixed as shown at fixed point 84. The second end 74 of flexible guide member 70 is fixed to the free end of flat portion 80 of spring 76 at joint 86. The joint 86 is free to move. The free end of the flat portion 82 of spring 76 is aligned with an end 87 (see FIG. 5) of the lower guide portion 29 of the guide arrangement 25, just above the uppermost handrail drive unit 56, and the resulting joint 88 is fixed at point 90. Thus, ends 74 and 87 are held in aligned, spaced relation by spring 76. The handrail 24 is selected such that it is stiff enough to bridge the gap 89 without buckling.

Figure 5:
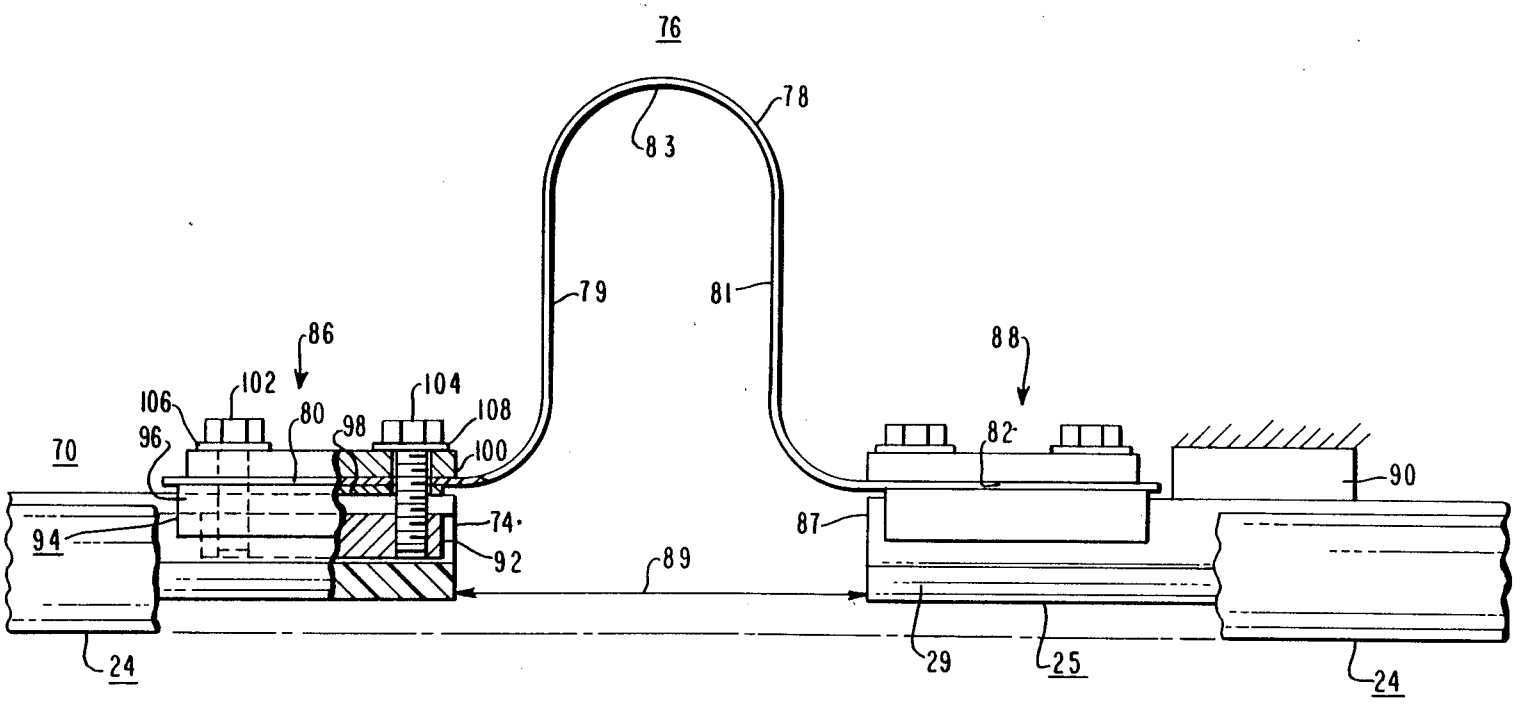
FIG. 5 is an elevational view, partially in section, of a plus-and-minus spring arrangement, shown schematically in FIGS. 2, 3 and 4, which may be used to lengthen or shorten curved guide sections of the handrail guide arrangement, according to the teachings of the invention.
Figure 6:
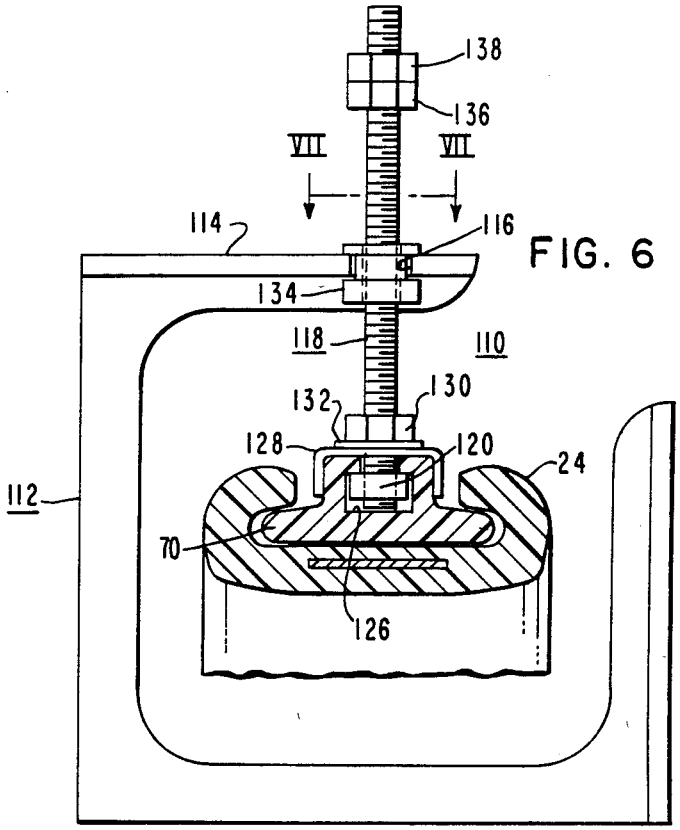
FIG. 6 is a cross-sectional view of the handrail guide and its associated handrail, taken adjacent to a floating guide arrangement, which is shown schematically in FIGS. 2, 3 and 4.
Figure 7:
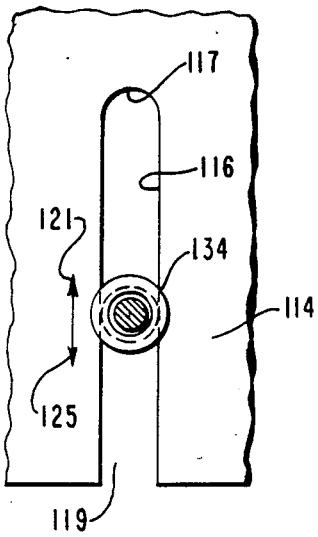
FIG. 7 is a view of the guide arrangement shown in FIG. 6, taken between and in the direction of arrows VII—VII.

FIG. 5 illustrates a practical implementation of the spring 76 shown in FIGS. 2, 3 and 4. Flexible guide member 70, which may have a cross-sectional configuration as shown in FIG. 6, may have a tapped, metallic bar 92 disposed within a longitudinal opening defined by the guide member. A metallic channel member 94 having spaced leg portions, such as leg portion 96, and a connecting bight 98, is disposed snugly over the uppermost side of flexible guide member 70, to prevent creep or plastic flow of the guide 70 when under pressure. The bight 98 has spaced openings aligned with spaced openings disposed in the flat portion 80 of spring 76. A metallic bar 100 is disposed over the top of flat portion 80, with bar 100 having openings aligned with the openings in the flat portion 80, the openings in bight 98, and the tapped openings in bar 92. Bolts 102 and 104 and associated lock washers 106 and 108 securely clamp the flat portion 80 of spring 76 to flexible guide member 70. The joint 88 between flat portion 82 of spring 76 and the lower guide portion 29 may be constructed the same as joint 86. The combination of the flexible guide member 70 and leaf spring 76 allow the curved portion or radius of the transition 34 to change, and to change the length of the curved flexible guide section or transition 34 accordingly, between the fixed points 84 and 90. Because the loop of the curved transition 34 rises instead of being a depending loop, a floating guide arrangement 110 may be utilized to prevent the loop from flopping over, i.e., move laterally. FIG. 6 is a cross-sectional view of the handrail 24 and flexible guide member 70, taken adjacent to a floating guide or lateral support arrangement 110 which may be used. FIG. 7 is a view of the guide arrangement 110, taken between and in the direction of arrows VII—VII in FIG. 6. A metallic C-shaped support element 112, which is fixed to the escalator truss 120, includes an arm 114 which includes a slot 116 having first and second ends 117 and 119, respectively. A long stud 118 having a square nut 120 adjacent one end is substantially vertically oriented, with the square nut 120 snapped into the longitudinal opening or channel 126 defined by the flexible guide member 70. A channel member 128, similar to channel member 94 shown in FIG. 5, is disposed over the opening to channel 126 with stud 118 extending upwardly through an opening therein. A nut 130 and washer 132 secure the channel 128, guide 70 and bolt 118 in assembled relation. In a preferred embodiment, a tubular, spool-like guide member 134 is arranged to slide in slot 116, and stud 118 extends through an opening in member 134. A nut 136 and jam nut 138 are threadably engaged with stud 118, to establish a vertical travel space which allows unimpeded movement of the flexible guide member 70 in the axial direction of the bolt 118. Also, there is no restriction on movement of the guide member 70 in the up or down travel direction of the escalator, while lateral movement of the guide member 70 is prevented. If ends 117 and 119 of slot 116 are uphill and downhill, respectively, member 134 will slide in the direction of arrow 121 when the escalator is traveling downwardly, and in the direction of arrow 125 when the escalator is traveling upwardly.

The construction of a lower flexible, curved guide section 37, except for having a reverse orientation, may be similar to that of the upper section 34, with like reference numerals being used to identify the various elements, except for the addition of a prime mark. Since the description would be the same, it will not be repeated. The loop in the lower flexible guide section 37 hangs downwardly, instead of rising, as in the upper flexible section 34. Thus, the floating support 110 is not needed in the lower flexible curved guide section 37, as there will be no tendency for the loop to flop over. Also, spring 76 associated with the upper flexible section, because of the rising loop, may be selected to be slightly stronger than the spring 76′ associated with the lower flexible loop, i.e., constructed of thicker steel.

The unit deflections of both springs are selected such that the U-shaped portion retains its unstressed configuration, as shown in FIG. 2, when the handrail 24 is being driven in either direction, but with no passengers exerting a load on the handrail. For example, on a 20 foot rise escalator having one handrail drive, spring 76 may be a 37 pound spring constructed of 0.090 inch thick steel, while spring 76′ may be a 25 pound spring constructed of 0.060 inch thick steel. Each of the springs 76 and 76′ may be extended, and each may be compressed, with reference to the unstressed neutral configuration. Thus, the springs are referred to as being plus-and-minus springs.

It will first be assumed that the escalator 10 is transporting passengers in the up travel direction, from landing 14 towards landing 16. Handrail drive 56 will thus drive handrail 24 in the down direction on the lower guide portion 29 of the handrail guide arrangement 25. Thus, the driving forces in handrail 24 are in the down direction on the lower guide portion 29, as illustrated by arrow 140 in FIG. 3. The upwardly traveling passengers "load" the handrail 24 on the upper guide portion 27 of guide arrangement 25, by placing a drag on it which is counter to the driving forces in the handrail. Thus, the passenger load induced forces in the handrail are in the downward direction on the upper guide portion 27, as illustrated by arrow 142 in FIG. 3. The driving forces 140 of handrail drive 56 pull the handrail 24 about guide end section 31, and the load forces 142 are tending to prevent the handrail from proceeding about the guide end section 31. This results in the handrail 24 trying to straighten out in the upper curved transition adjacent to the upper newel 30, which in the prior art would tend to pull the handrail 24 off of the handrail guide. With the present invention, the flexible guide member 70 moves downwardly, flattening its curve, i.e., the center 35 of the curve moves substantially downward to define a segment of a much larger circle having a center 35′. While points 84 and 90 remain fixed, the guide distance between the points 84 and 90 is reduced as the curve flattens by stressing spring 76 to close the gap or spacing 89 shown in FIG. 5, which spacing is between the normally parallel leg portions 79 and 81. Thus, the flexible guide portion 34 moves downwardly with the handrail 24, shortening the guide length between fixed points 84 and 90 to substantially reduce the magnitude of the forces which are developed between the handrail 24 and the adjacent guide section. The rollers commonly used in the prior art to prevent the handrail from popping off the guide in this area are unnecessary, and frictional wear of the handrail 24 and the adjacent guide element is substantially reduced.

As shown in FIG. 3, the drive and load forces in handrail 24, represented by arrows 140 and 142, respectively, are both directed towards guide end section 33, tending to cause the handrail 24 to bunch up about the lower newel 32. This tendency is overcome by the flexible, curved guide section or transition 37. The flexible, curved member 70′ moves downwardly from the broken outline position, and spring 76′ is extended, i.e., the gap 89 between the leg portions 79 and 81 of the U-shaped section increases. The radius of curvature of the curved member 70′ reduces, moving the center of the curve down from point 39 to point 39′. If there is no temporary stretching of handrail 24, the guide distance between points 84′ and 90′ would increase by the same amount that the guide distance between points 84 and 90 is reduced. If the handrail 24 temporarily stretches due to the load induced forces, any stretch would be accommodated by the lower curved transition 37, causing spring 76′ to open up slightly more than spring 76 closes.

If the escalator 10 is transporting passengers from the upper landing or terminal 16 to the lower landing 14, handrail drive 56 would drive handrail 24 upwardly on the lower guide portion 29, inducing drive forces therein which are represented by arrow 144 in FIG. 4. The downwardly traveling passengers "load" the handrail 24 on the upper guide portion or section 27 by resisting the load induced forces, and thus the load induced forces on the upper guide section 29 are represented by arrow 146 in FIG. 4. Since the load and drive forces are both directed away from guide end section 38, the handrail 24 is highly stressed in the lower guide end section 33 and the handrail 24 tends to straighten out in the lower curved transition 37. The curve flattens, moving the radius of the resulting curve from point 39 to point 39″. Spring 76′ is compressed as the curve in the guide section 70′ moves upwardly and flattens, compared with the position shown in FIG. 2. Thus, the handrail-guide forces readjust the position of the guide section, rather than create undue forces at their interface which wears both the guide and handrail.

The drive and load forces 144 and 146 are both directed towards the upper guide end 31, tending to cause the handrail 24 to bunch up. This tendency is alleviated, as the handrail forces cause the curved guide loop to raise at the upper curved transition, from the broken outline or normal position, and spring 76 opens up or extends to increase the guide distance between points 84 and 90. The floating guide 110 guides the vertical rise, and up/down movement of the loop along the incline, and it prevents it from moving laterally or flopping over. As the curve becomes more pronounced, the center of the resulting curve moves from point 35 to point 35′, closer to the lower guide portion 29. If the handrail 24 does not temporarily stretch, the guide distance between points 84 and 90 will increase by the same amount that the guide distance between points 90′ and 84′ decreases. Any temporary stretch of handrail is accommodated by the spring located in the upper curved transition 34.

In summary, there has been disclosed new and improved continuously self-adjusting handrail apparatus which reduces the magnitude of the forces developed between the handrail and its guide which wear the handrail and guide and tend to pop the handrail from its guide when the handrail is "loaded" by passengers grasping the handrail. Flexible guide sections at opposite ends of the associated transportation apparatus, along with plus-and-minus springs, self-adjust their curvature and guide lengths in opposite directions, to automatically lengthen one section and shorten the other. Thus, the handrail follows its guide without as much wear producing friction, and without the necessity of resorting to the rollers used in the prior art to keep the handrail on its guide.

I claim as my invention:

1. Continuously self-adjusting handrail apparatus for reducing the magnitude of the forces which act to dislodge a handrail of transportation apparatus from its guide, comprising:

handrail guide means which defines a substantially continuous loop having upper and lower portions joined by first and second curved end portions, a continuous handrail disposed on said guide means, with the handrail being available to be grasped and thereby loaded by passengers while it is on the upper portion of said guide means, drive means coupled to said handrail while it is on the lower portion of said guide means which pushes and pulls said handrail about said handrail guide means, said handrail guide means including first and second curved sections in the lower portion, adjacent to the first and second curved end portions, respectively, whose lengths change in opposite directions, in response to load induced forces in said handrail, and floating guide means associated with at least one of said first and second curved sections which permits unrestricted movement of the section in a vertical plane, and which prevents movement of the curved section transverse to said vertical plane.

* * * * *